US006883887B1

(12) United States Patent
Mogensen

(10) Patent No.: US 6,883,887 B1
(45) Date of Patent: Apr. 26, 2005

(54) FOOD FINDER

(76) Inventor: Timothy Mogensen, N. 6490 Crystal Spring Dr., Ladysmith, WI (US) 54848

( * ) Notice: Subject to any disclaimer, the term of this patent is extended or adjusted under 35 U.S.C. 154(b) by 166 days.

(21) Appl. No.: 10/306,845

(22) Filed: Nov. 27, 2002

Related U.S. Application Data

(60) Provisional application No. 60/344,273, filed on Jan. 3, 2002.

(51) Int. Cl.[7] ..... A47B 96/04
(52) U.S. Cl. ..... 312/408; 312/305
(58) Field of Search ..... 211/144, 131, 211/187; 312/408, 125, 135, 305, 238

(56) References Cited

U.S. PATENT DOCUMENTS 2,588,563 A * 3/1952 Paul ..... 62/381
2,680,668 A * 6/1954 Stanfiel et al. ..... 312/305
2,724,629 A * 11/1955 Atchison ..... 312/274
2,831,582 A * 4/1958 Cody ..... 108/141
3,769,805 A 11/1973 Corini
4,191,437 A 3/1980 Funke
4,688,686 A * 8/1987 Mitts et al. ..... 211/183
5,277,488 A * 1/1994 Cleary et al. ..... 312/408
5,567,026 A 10/1996 Lacewell
5,810,462 A 9/1998 Lee

* cited by examiner

*Primary Examiner*—Ramon O Ramirez
(74) *Attorney, Agent, or Firm*—Matthew J. Peirce

(57) ABSTRACT

A food storage system to be used in combination with a refrigerator is disclosed. The food storage system would comprise several rounded trays that would rotate around 360 degrees. The center pole on which the trays would be mounted would be threaded, allowing a user to easily relocate various trays or shelves within the refrigerator to different height levels as desired.

3 Claims, 2 Drawing Sheets

FIG 1
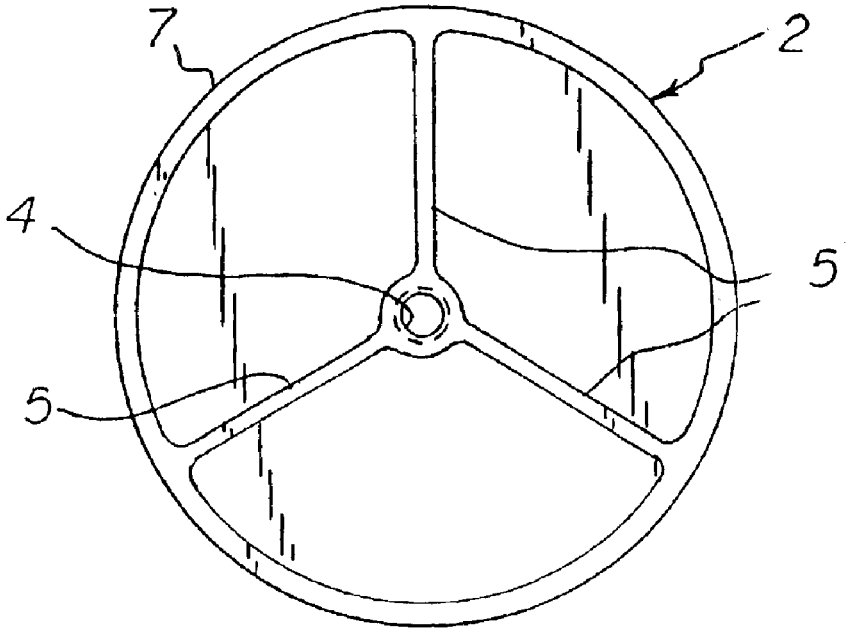
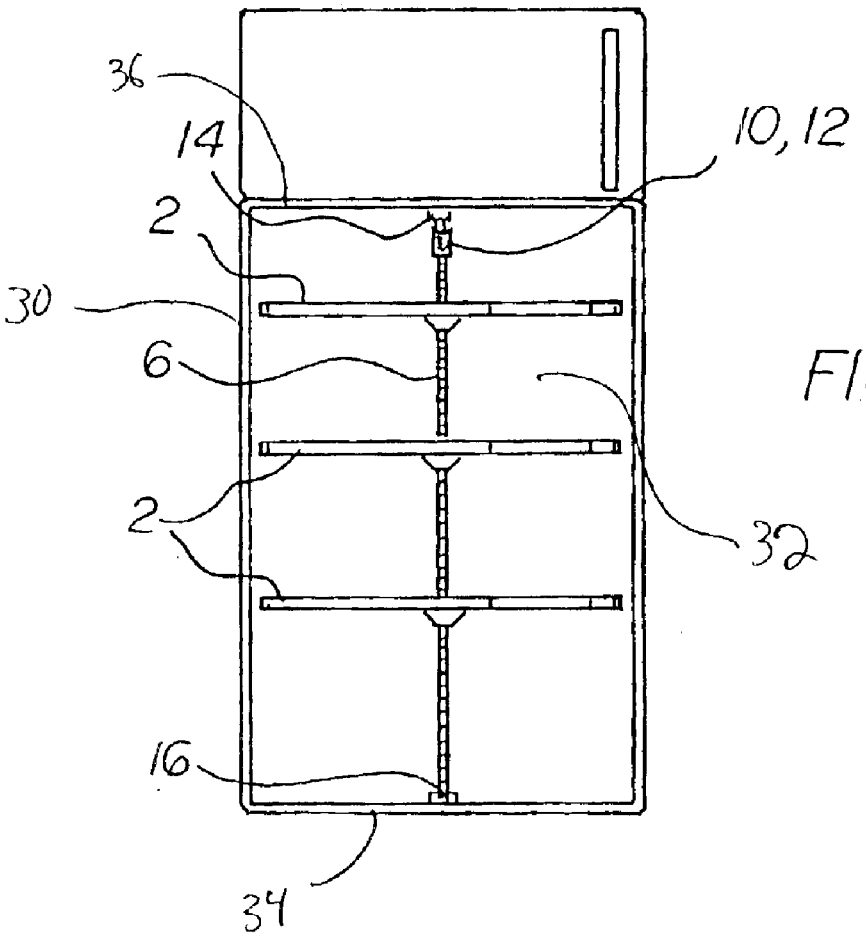
FIG 2

FOOD FINDER

This application claims benefit of Ser. No. 60/344,273 filed Jan. 3, 2002.

I. BACKGROUND OF THE INVENTION

The present invention concerns that of a new and improved apparatus to be used with a refrigerator.

II. DESCRIPTION OF THE PRIOR ART

U.S. Pat. No. 5,810,462, issued to Lee, discloses a refrigerator shelf with a rotary shelf capable of swinging out when a door is extended.

U.S. Pat. No. 5,567,026, issued to Lacewell, discloses a case for displaying products.

U.S. Pat. No. 4,191,437, issued to Funke, discloses a refrigerator storage system comprised of rotatable shelves on a circular track for easily withdrawing items.

U.S. Pat. No. 3,769,805, issued to Corini, discloses a case for displaying products.

III. SUMMARY OF THE INVENTION

The present invention concerns that of a new and improved apparatus to be used with a refrigerator. The apparatus would be a new food storage system that would comprise several rounded trays that would rotate around 360 degrees. The center pole on which the trays would be mounted would be threaded, allowing a user to easily relocate various trays or shelves within the refrigerator to different height levels as desired.

There has thus been outlined, rather broadly, the more important features of a food storage system for a refrigerator that the detailed description thereof that follows may be better understood and in order that the present contribution to the art may be better appreciated. There are, of course, additional features of the food storage system for a refrigerator that will be described hereinafter and which will form the subject matter of the claims appended hereto.

In this respect, before explaining at least one embodiment of the food storage system for a refrigerator in detail, it is to be understood that the food storage system for a refrigerator is not limited in its application to the details of construction and to the arrangements of the components set forth in the following description or illustrated in the drawings. The food storage system for a refrigerator is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present food storage system for a refrigerator. It is important, therefore, that the claims be regarded as including such equivalent constructions insofar as they do not depart from the spirit and scope of the present invention.

It is therefore an object of the present invention to provide a food storage system for a refrigerator which has all of the advantages of the prior art and none of the disadvantages.

It is another object of the present invention to provide a food storage system for a refrigerator which may be easily and efficiently manufactured and marketed.

It is another object of the present invention to provide a food storage system for a refrigerator which is of durable and reliable construction.

It is yet another object of the present invention to provide a food storage system for a refrigerator which is economically affordable and available for relevant market segment of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

FIG. 1 shows a top view of a tray used with the present invention.

FIG. 2 shows a side view of the center pole and a plurality of trays mounted within a refrigerator.

V. DESCRIPTION OF THE PREFERRED EMBODIMENT

Figure 3:
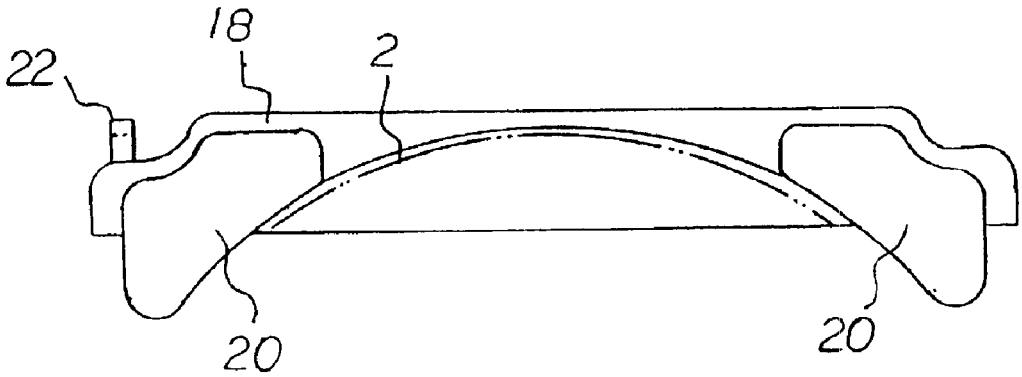
FIG. 3 shows a top view of a refrigerator door that would be used with the present invention.

Priority is hereby claimed to application 60/344,273, filed on Jan. 3, 2002.

FIG. 1 shows a top view of a tray 2 used with the present invention. Each tray 2 would be circular and preferably have a diameter of approximately twenty-five inches. Each tray 2 would be divided into three sections by a series of dividers 5, although a greater or lesser number of sections per tray could be accommodated.

Centrally located on each tray 2 would be a threaded hole 4 for the placement of center pole 6. Threaded hole 4 would preferably be approximately one and one-half inches in diameter. In addition, each of the dividers 5 would preferably be approximately three-eights of an inch in height, with boundaries 7 of the tray 2 also being approximately three-eights of an inch in height.

FIG. 2 shows a side view of the center pole 6 and a plurality of trays 2 mounted within a refrigerator 30. Center pole 6 would preferably be approximately one and one-half inches in diameter and would be threaded to allow proper mounting of each tray 2 on center pole 6. The refrigerator would have an inner compartment 32 that would have twoinner surfaces, a bottom inner surface 34 and a top inner surface 36.

Center pole 6 would have two ends, a top end and a bottom end. The top end of center pole 6 would have a coupling 10. In addition, the top end of center pole 6 would have an incorporated spring 12. To properly mounted center pole 6 within a refrigerator 12, the refrigerator 12 would have a top hole 14 and a bottom hole 16 that would each be about one inch deep. In order to fit center pole 6 within the pair of holes 14 and 16, a user would force spring 12 together, place the top end of center pole 6 within hole 14 and the bottom end of center pole 6 within hole 16, and then let go of center pole 6. Spring 12 would then push each end into its respective hole and keep center pole 6 fixedly in place. Alternatively, a user could first place the bottom end of the center pole 6 and then place the top end of the center pole 6.

FIG. 3 shows a top view of a refrigerator door 18 that would be used with the present invention. Refrigerator door 18 would be used in lieu of a regular refrigerator door and curved outward to accommodate the circular trays 2 present within the refrigerator 12. Refrigerator door 18 would have a few spaces 20 for food at multiple levels on the inside surface of refrigerator door 18. Refrigerator door 18 would have an external handle 22 to open and close refrigerator door 18.

Figure 4:
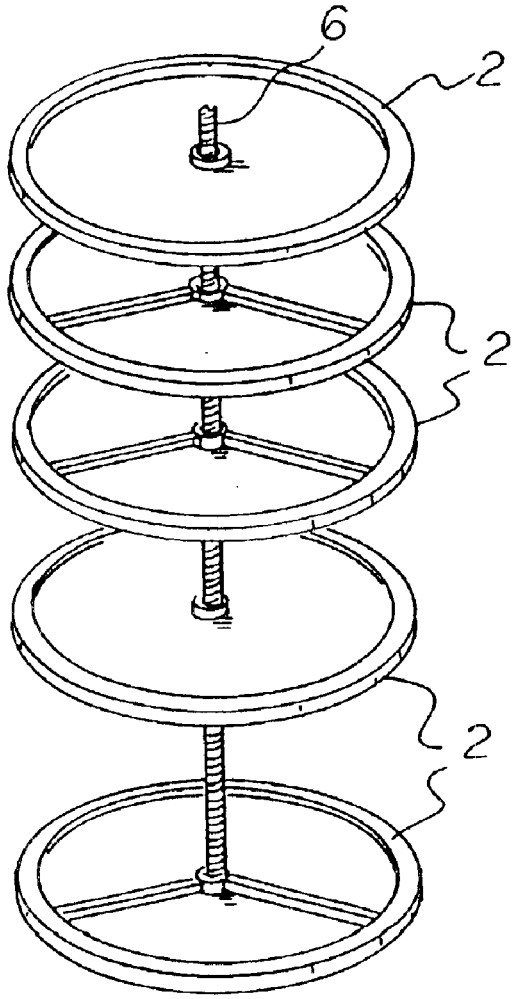
FIG. 4 shows a perspective view of the present invention as it would appear in use.

FIG. 4 shows a perspective view of the present invention as it would appear in use. When in use, a user would simply grab a tray 2 and rotate it, causing all the trays 2 to simultaneously rotate. If a user would want to place a particular tray 2 to a different height level, then the user would simply make several revolutions of the particular tray 2 until it would be at the desired height on center pole 6.

I claim:

1. A food storage system for use in a refrigerator in combination with a refrigerator, the refrigerator having an inner compartment for storing food, the inner compartment having two inner surfaces comprising a top inner surface and a bottom inner surface, the food storage system comprising:

(a) a center pole having two ends, a top end and a bottom end, the center pole having a length, the center pole having a diameter of one and one-half inches in diameter, the center pole being externally threaded, (b) a plurality of circular trays, each circular tray having two surfaces, a top surface and a bottom surface, each circular tray having a centrally located threaded hole, the centrally located threaded hole having a diameter of one and one-half inches, each circular tray being threadably mounted on the center pole via the centrally located threaded hole, (c) a plurality of dividers located on the top surface of each circular tray, each divider having a height of three-eighths of an inch, and (d) means for removably mounting the center pole within the inner compartment of a refrigerator.

2. A food storage system for use in a refrigerator in combination with a refrigerator according to claim 1 wherein the means for removably mounting the center pole within the inner compartment of a refrigerator further comprises:

(a) a coupling attached to the top end of the center pole, (b) a spring attached to the top end of the center pole, (c) a pair of holes comprising a top hole and a bottom hole, the top hole located on the top inner surface in the inner compartment of the refrigerator, the bottom hole located on the bottom inner surface in the inner compartment of the refrigerator, (d) wherein a user would place the bottom end of the center pole within the bottom hole located on the bottom inner surface in the inner compartment of the refrigerator, and further wherein a user would compress the spring and coupling located on the top end of the center pole, and further wherein the user would place the top end of the center pole within the top hole located on the top inner surface in the inner compartment of the refrigerator.

3. A food storage system for use in a refrigerator in combination with a refrigerator according to claim 2 wherein the plurality of dividers located on the top surface of each circular tray would amount to three dividers.

* * * * *